US006102778A

United States Patent [19]

Morita

[11] Patent Number: 6,102,778

[45] **Date of Patent: *Aug. 15, 2000**

[54] WAFER LAPPING METHOD CAPABLE OF ACHIEVING A STABLE ABRASION RATE

[75] Inventor: Tomotake Morita, Tokyo, Japan

[73] Assignee: NEC Corporation, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/758,747

[22] Filed: Dec. 6, 1996

[30] Foreign Application Priority Data

Dec. 8, 1995 [JP] Japan ..... 7-320307

[51] Int. Cl.[7] ..... B24B 1/00

[52] U.S. Cl. ..... 451/41; 451/285; 451/287

[58] Field of Search ..... 451/41, 285–289, 451/60, 444, 446

[56] References Cited

U.S. PATENT DOCUMENTS

| | | | |
|---|---|---|---|
| 5,167,667 | 12/1992 | Prigge et al. | 8/137 |
| 5,216,843 | 6/1993 | Breivogel et al. | 451/285 |
| 5,329,732 | 7/1994 | Karlsrud et al. | 451/289 |
| 5,421,768 | 6/1995 | Fujiwara et al. | 451/285 |
| 5,536,202 | 7/1996 | Appel et al. | 451/285 |
| 5,584,749 | 12/1996 | Mitsuhashi et al. | 451/285 |
| 5,643,067 | 7/1997 | Katsuoka et al. | 451/287 |

FOREIGN PATENT DOCUMENTS 0371147 6/1990 European Pat. Off. .

*Primary Examiner*—Derris H. Banks
*Attorney, Agent, or Firm*—Hayes, Soloway, Hennessey, Grossman & Hage, P.C.

[57] ABSTRACT

In a wafer lapping method including a first step of lapping irregularities of a surface of a wafer to flatten the surface of the wafer by pressing the surface of the wafer against an abrasion pad (2) with an abrasive agent containing abrasive particles fed onto the abrasion pad, the method further includes a second step of feeding, instead of the abrasive agent upon completion of the lapping step, onto the abrasion pad a chemical solution (6) for use in preventing agglomeration of the abrasive particles contained in the abrasive agent which remains on the abrasion pad. This results in preventing the abrasion pad from drying. Following the second step, a third step is carried out for lapping irregularities of a surface of a different wafer to flatten the surface of the different wafer by pressing the surface of the different wafer against the abrasion pad with the abrasive agent fed onto the abrasion pad instead of the chemical solution. For the the different wafer, an abrasion rate can be obtained which is similar to that for the wafer.

6 Claims, 9 Drawing Sheets

WAFER LAPPING METHOD CAPABLE OF ACHIEVING A STABLE ABRASION RATE

BACKGROUND OF THE INVENTION

This invention relates to a method of lapping a wafer and, in particular, to a wafer lapping method including the step of lapping irregularities of a surface of the wafer to flatten the surface of the wafer with a semiconductor device formed on the surface of the wafer.

In a manufacturing process of a semiconductor device, use is made of a wafer lapping method of lapping, by the use of a wafer lapping device, irregularities resulting from the presence of elements and wirings formed on a surface of a wafer to flatten the surface of the wafer.

As will later be described, a conventional wafer lapping method is incapable of achieving a stable abrasion rate without increasing the running cost.

SUMMARY OF THE INVENTION

It is an object of this invention to provide a wafer lapping method capable of achieving a stable abrasion rate without increasing the running cost.

Other objects of this invention will become clear as the description proceeds.

On describing the gist of a first aspect of this invention, it is possible to understand that a wafer lapping method includes the step of lapping irregularities of a surface of a wafer to flatten the surface of the wafer by pressing the surface of the wafer against an abrasion pad with an abrasive agent containing abrasive particles fed onto the abrasion pad.

According to the first aspect of this invention, the above-understood method comprises the step of: feeding, instead of the abrasive agent upon completion of the lapping step, onto the abrasion pad a chemical solution for use in preventing agglomeration of the abrasive particles contained in the abrasive agent which remains on the abrasion pad.

On describing the gist of a second aspect of this invention, it is possible to understand that a wafer lapping method includes a first step of lapping, by the use of a wafer lapping device comprising an abrasion pad and a feeding section for feeding onto the abrasion pad an abrasive agent containing abrasive particles, irregularities of a surface of a wafer to flatten the surface of the wafer by pressing the surface of the wafer against the abrasion pad with the abrasive agent fed onto the abrasion pad from the feeding section.

According to the second aspect of this invention, the above-understood method comprises: a second step of feeding, instead of the abrasive agent in a standby state of the wafer lapping device after completion of the first step, onto the abrasion pad from the feeding section a chemical solution for use in preventing agglomeration of the abrasive particles contained in the abrasive agent which remains on the abrasion pad.

Preferably, in this case, the above-understood method further comprises: a third step of lapping, following the second step, irregularities of a surface of a different wafer to flatten the surface of the different wafer by pressing the surface of the different wafer against the abrasion pad with the abrasive agent fed onto the abrasion pad from the feeding section instead of the chemical solution.

On describing the gist of a third aspect of this invention, it is possible to understand that a wafer lapping method includes: a first lot-lapping step of successively lapping, by the use of a wafer lapping device comprising an abrasion pad and a feeding section for feeding onto the abrasion pad an abrasive agent containing abrasive particles, irregularities of surfaces of a first lot of wafers to successively flatten the surfaces of the first lot of wafers by successively pressing the surfaces of the first lot of wafers against the abrasion pad with the abrasive agent fed onto the abrasion pad from the feeding section; and a second lot-lapping step of successively lapping, by the use of the wafer lapping device, irregularities of surfaces of a second lot of wafers to successively flatten the surfaces of the second lot of wafers by successively pressing the surfaces of the second lot of wafers against the abrasion pad with the abrasive agent fed onto the abrasion pad from the feeding section.

According to the third aspect of this invention, the above-understood method comprises: a chemical solution feeding step of feeding, instead of the abrasive agent in a standby state of the wafer lapping device between the first and the second lot-lapping steps, onto the abrasion pad from the feeding section a chemical solution for use in preventing agglomeration of the abrasive particles contained in the abrasive agent which remains on the abrasion pad.

On describing the gist of a fourth aspect of this invention, it is possible to understand that a wafer lapping method includes a plurality of wafer-lapping steps of successively lapping irregularities of surfaces of a plurality of wafers to successively flatten the surfaces of the plurality of wafers by successively pressing the surfaces of the plurality of wafers against a surface of an abrasion pad with an abrasive agent containing abrasive particles fed onto the surface of the abrasion pad.

According to the fourth aspect of this invention, the above-understood method comprises: a dressing step of dressing, between the plurality of wafer-lapping steps, the surface of the abrasion pad with a chemical solution fed onto the surface of the abrasion pad instead of the abrasive agent, the chemical solution being for use in preventing agglomeration of the abrasive particles contained in the abrasive agent which remains on the surface of the abrasion pad.

On describing the gist of a fifth aspect of this invention, it is possible to understand that a wafer lapping method includes a plurality of wafer-lapping steps of successively lapping irregularities of surfaces of a plurality of wafers to successively flatten the surfaces of the plurality of wafers by successively pressing the surfaces of the plurality of wafers against an abrasion pad with an abrasive agent containing abrasive particles fed onto the surface of the abrasion pad.

According to the fifth aspect of this invention, the above-understood method comprises: a detaching step of detaching, upon completion of each of the plurality of wafer-lapping steps, each of the plurality of wafers from the abrasion pad with a chemical solution fed onto the abrasion pad instead of the abrasive agent, the chemical solution being for use in preventing agglomeration of the abrasive particles contained in the abrasive agent which remains on the abrasion pad.

DESCRIPTION OF THE PREFERRED EMBODIMENTS

Figure 1:
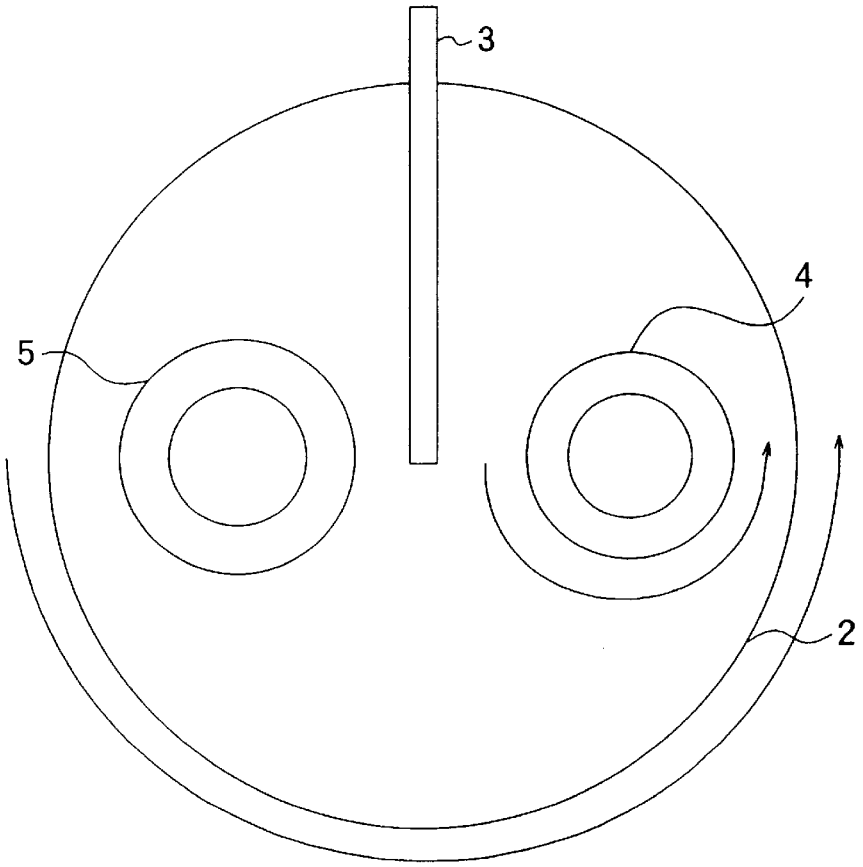
FIG. 1 is a plan view of a wafer lapping device used in a conventional wafer lapping method and in a wafer lapping method according to this invention.
Figure 2:
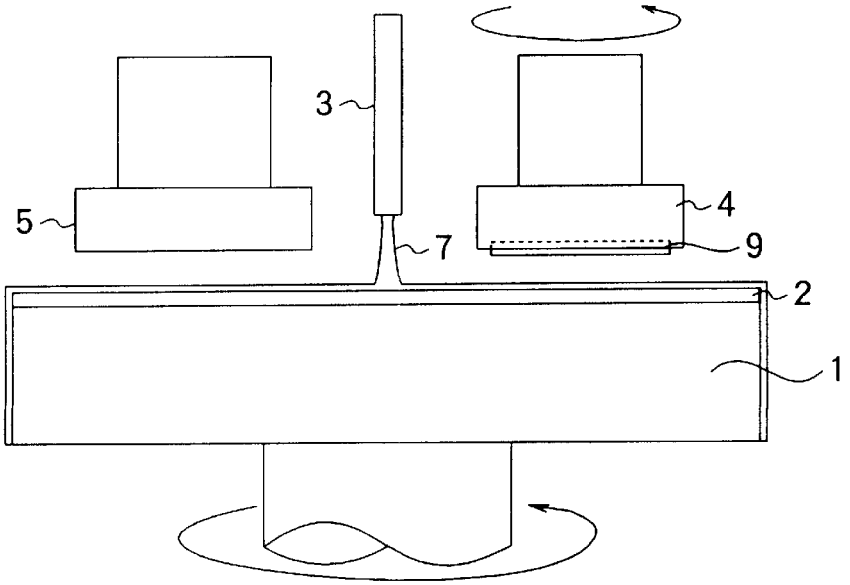
FIG. 2 is a side view of the wafer lapping device illustrated in FIG. 1.

Referring to FIGS. 1 and 2, description will first be made as regards the structure of a wafer lapping device.

FIG. 1 is a plan view of the wafer lapping device and FIG. 2 is a side view of the wafer lapping device.

In FIGS. 1 and 2, an abrasion table 1 of a disk shape is rotated, for example, in a counterclockwise direction. An abrasion pad 2 of foamed polyurethane is applied on the abrasion table 1. Above the abrasion table 1, a single common chemical solution feeding port or a plurality of specific-purpose chemical solution feeding ports 3 and a wafer seating base 4 are arranged. A wafer 9 is held on the bottom of the wafer seating base 4. Above the wafer seating base 4, provided are a pressing mechanism (not shown) for pressing the wafer 9 against the abrasion pad 2 on the abrasion table 1 and a rotating mechanism (not shown) for rotating the wafer 9 in a direction (the counterclockwise direction in the example being illustrated) similar to that of the rotation of the abrasion table 1. In addition, a surface adjusting mechanism 5 is arranged which is for dressing the abrasion pad 2 so that an abrasion rate is kept stable without being decreased.

In the wafer lapping device of the above-mentioned structure, an abrasive agent 7 is fed from the chemical solution feeding port 3 to flow onto the abrasion table 1 being rotated. While the wafer seating base 4 is rotated, the wafer 9 is pressed against the abrasion pad 2. Thus, irregularities on the wafer 9 are lapped.

Figure 3A:
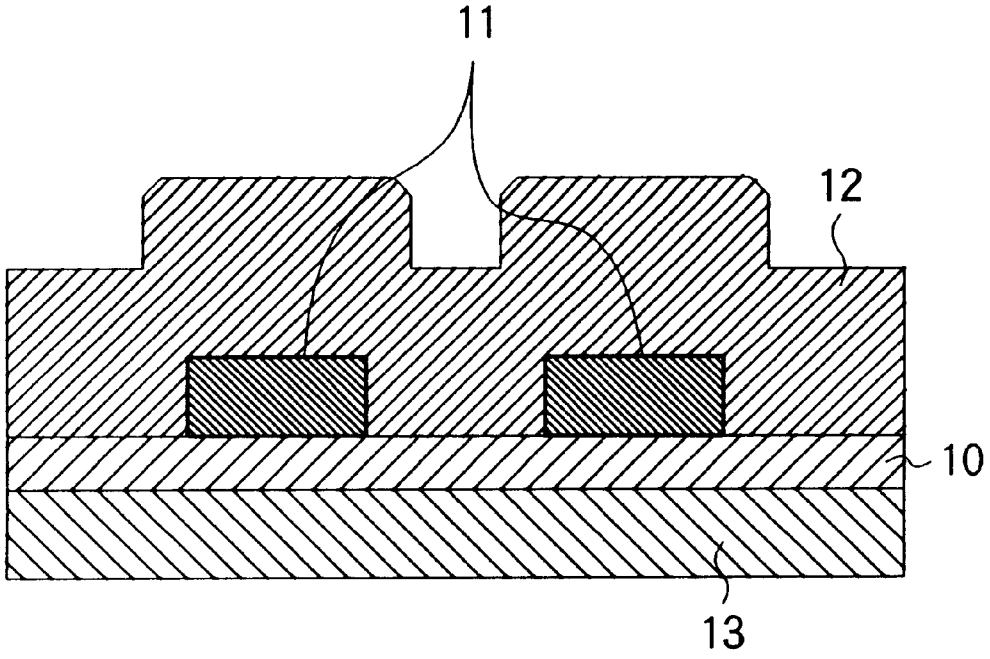
FIGS. 3A and 3B are sectional views of a wafer for describing a wafer lapping operation when the wafer is lapped by using the wafer lapping device illustrated in FIGS. 1 and 2.
Figure 3B:
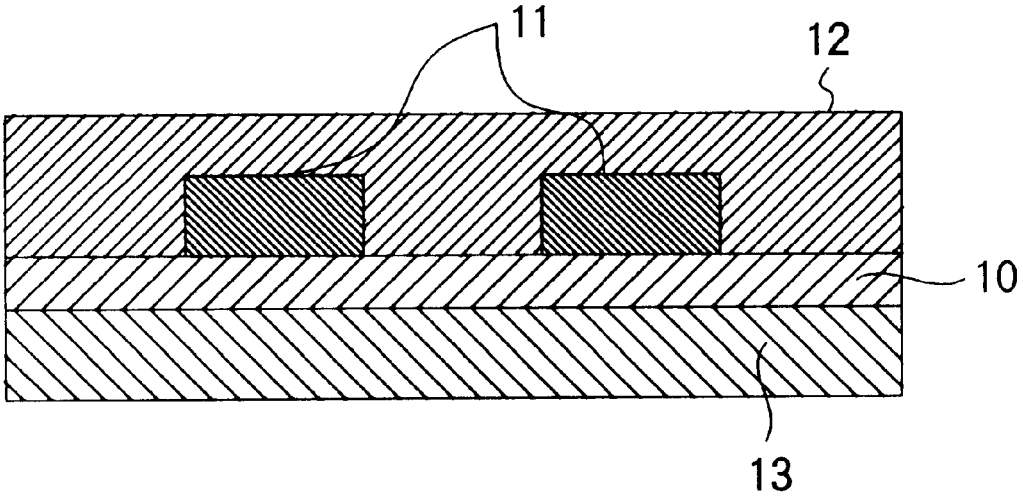

For example, it is assumed that a semiconductor device is subjected to a lapping operation in a predetermined condition by the use of the wafer lapping device illustrated in FIGS. 1 and 2. The semiconductor device comprises a semiconductor wafer 13, an insulator film 10 formed thereon, Al wirings 11 selectively formed on the insulator film, and a plasma oxide film (interlayer insulator film) 12 covering the Al wirings 11 and the insulator film 10 as illustrated in FIG. 3A. As a result of the lapping operation, protruding portions of the plasma oxide film 12 are selectively lapped to thereby flatten the plasma oxide film 12 as shown in FIG. 3B.

Figure 4:
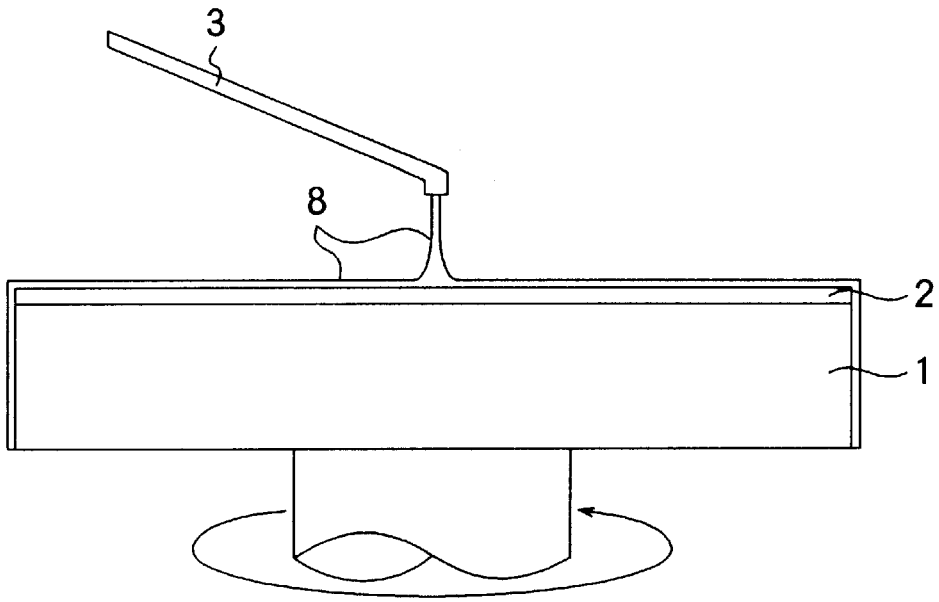
FIG. 4 (PRIOR ART)
FIG. 4 is a side view for describing a standby state of the wafer lapping device of FIGS. 1 and 2 according to the conventional wafer lapping method.

In a conventional wafer lapping method, when the wafer lapping device is in a standby state between a lot processing step for a lot of wafers and another lot processing step for another lot of wafers, pure water 8 is made to flow onto the abrasion pad 2 instead of the abrasive agent 7 as illustrated in FIG. 4 in order to prevent the abrasion pad 2 from drying. This is because, if the abrasion pad 2 dries in the standby state, the abrasion pad 2 is varied in elastic characteristic. Such variation has a great influence upon the abrasion rate. In this event, pad adjustment is inevitably required when the lapping operation is restarted.

Figure 5:
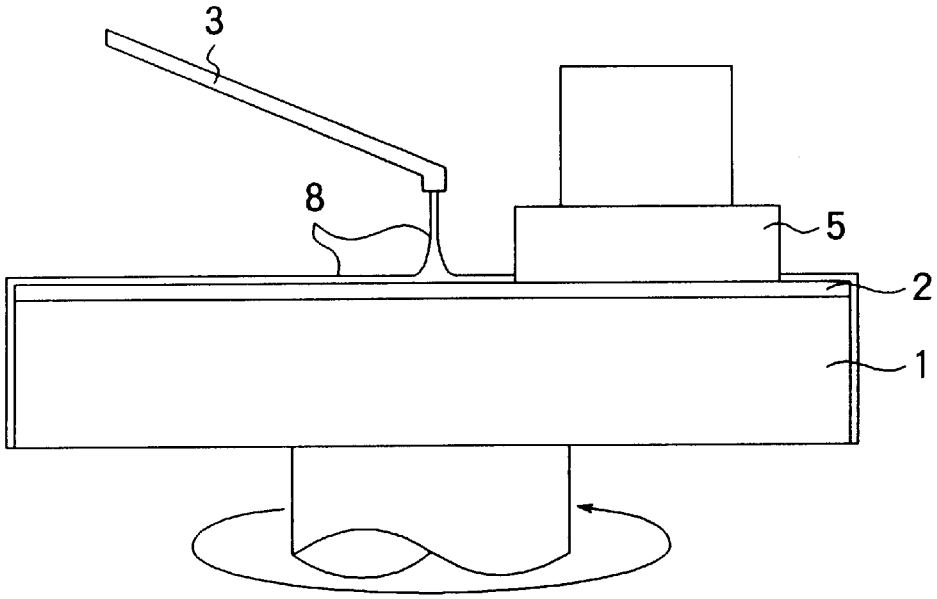
FIG. 5 (PRIOR ART)
FIG. 5 is a side view for describing an abrasion pad dressing operation of the wafer lapping device of FIGS. 1 and 2 according to the conventional wafer lapping method.

In case where a plurality of wafer processing steps are successively carried out, the surface of the abrasion pad 2 is dressed by the surface adjusting mechanism 5 between one wafer processing step and another wafer processing step while the pure water 8 (or the abrasive agent) is made to flow as illustrated in FIG. 5.

Figure 6:
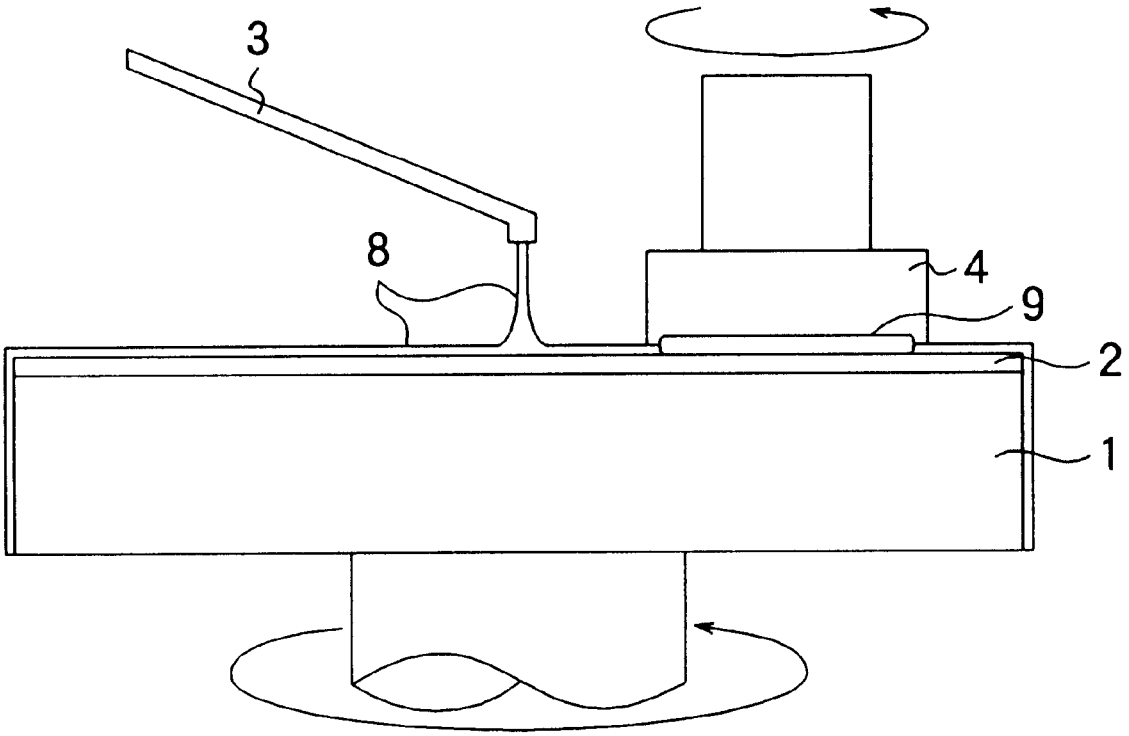
FIG. 6 (PRIOR ART)
FIG. 6 is a side view for describing a wafer detaching operation carried on a lapping completion state of the wafer lapping device of FIGS. 1 and 2 according to the conventional wafer lapping method.

In case where a plurality of the wafer processing steps are successively carried out, the wafer 9 is detached from the abrasion pad 2 upon completion of the lapping operation of the wafer 9 while the pure water is made to flow as illustrated in FIG. 6 in order to facilitate the detachment of the wafer 9 from the abrasion pad 2 and to softly wipe the abrasive agent adhered onto the surface.

However, the pure water 8 flowing onto the abrasion pad 2 in the conventional wafer lapping method results in following disadvantages.

Figure 7:
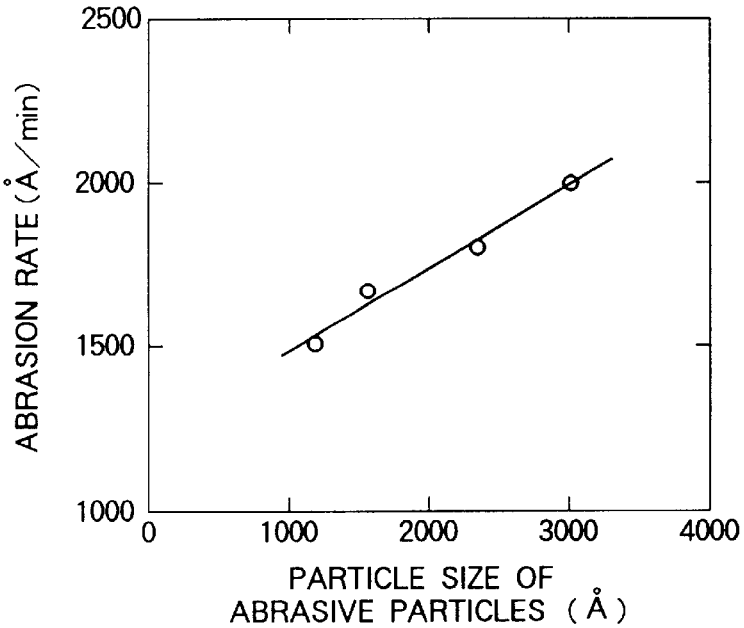
FIG. 7 (PRIOR ART)
FIG. 7 is a graph showing the relationship between a particle size of abrasive particles used in the conventional wafer lapping method and a resultant abrasion rate.

For example, if abrasive particles in the abrasive agent contain silica, a dispersion characteristic is maintained by repulsion of charged particles of silica. In an alkali medium, negative electricity is maintained on the surfaces of the particles so that the particles are mutually repulsive. It is noted here that, when a pH is lowered to a level not higher than 8.5, the particles are agglomerated. If a large amount of the pure water is made to flow while the abrasive agent remains on the abrasion pad 2 or if the abrasive agent is made to flow while the pure water remains on the abrasion pad, the abrasive particles are agglomerated. Following the agglomeration, the abrasive particles has an increased particle size to raise the abrasion rate as illustrated in FIG. 7.

Figure 8:
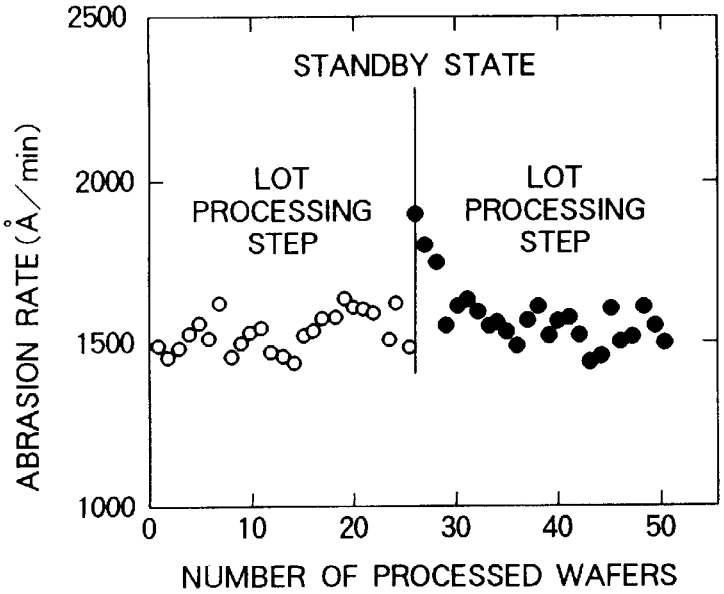
FIG. 8 (PRIOR ART)
FIG. 8 is a graph showing variation of the abrasion rate according to the conventional wafer lapping method described in FIG. 4.

When the pure water 8 is made to flow onto the abrasion pad in the standby state of the device between one lot processing step and another lot processing step as illustrated in FIG. 4, the abrasion rate immediately after the standby state is greater than that before the standby state as illustrated in FIG. 8. Because of such a high abrasion rate, the lapping operation is excessive if an abrasion time is selected to be equal to that before the standby state. In order to avoid such excessive lapping operation during a production run, a dummy run is required upon the restart of the lapping operation so as to stabilize the abrasion rate. Disadvantageously, such dummy run deteriorates the work efficiency and increases the running cost. If the abrasive agent is made to flow instead of the pure water 8, the running cost is increased.

Figure 9:
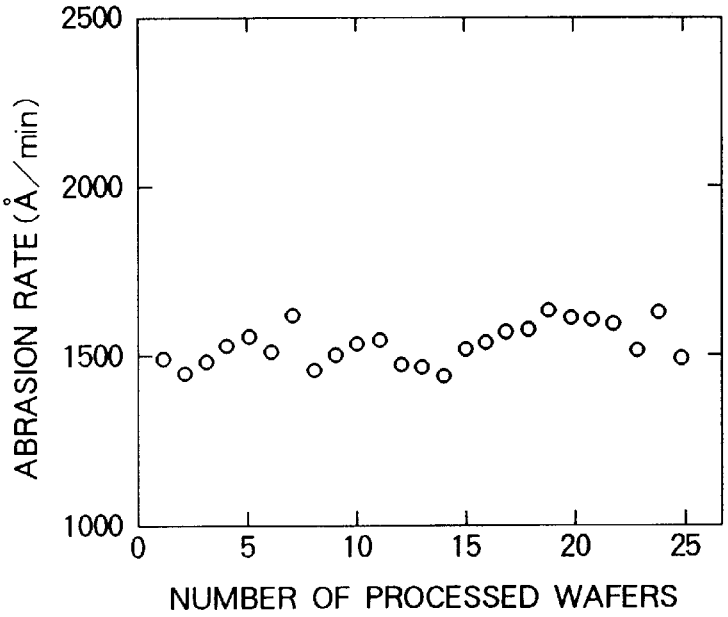
FIG. 9 (PRIOR ART)
FIG. 9 is a graph showing variation of the abrasion rate according to the conventional wafer lapping method described in FIG. 5.

In case where a plurality of the wafer processing steps are successively carried out, if the surface of the abrasion pad 2 is dressed between one wafer processing step and another wafer processing step while the pure water 8 is made to flow onto the abrasion pad 2 as illustrated in FIG. 5, the abrasion rate fluctuates between the wafers as illustrated in FIG. 9. In order to carry out the lapping operation stably between the wafers, the pure water 8 on the abrasion pad must be fully replaced by the abrasive agent in an early stage of the lapping operation. This requires a large amount of the abrasive agent and therefore increases the running cost. If the surface of the pad is dressed while the abrasive agent is made to flow instead of the pure water 8, a large amount of the abrasive agent is required and therefore increases the running cost although the lapping operation is stable between the wafers.

Figure 10:
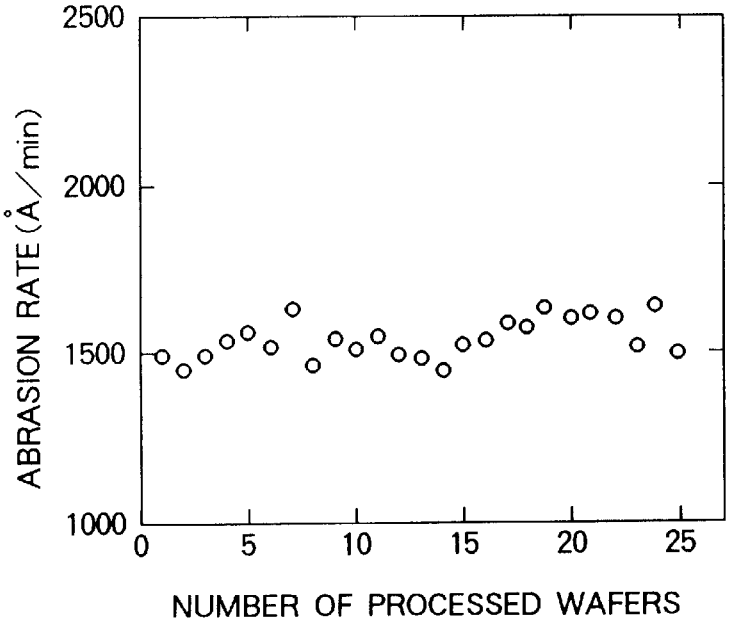
FIG. 10 (PRIOR ART)
FIG. 10 is a graph showing variation of the abrasion rate according to the conventional wafer lapping method described in FIG. 6.

In case where a plurality of the wafer processing steps are successively carried out, if the wafer 9 is detached from the abrasion pad 2 upon completion of the lapping operation of the wafer 9 while the pure water 8 is made to flow onto the abrasion pad 2 as illustrated in FIG. 6, the abrasion rate fluctuates between the wafers as illustrated in FIG. 10. In order to carry out the lapping operation stably between the wafers, the pure water 8 on the abrasion pad 2 must be fully replaced by the abrasive agent in the early stage of the lapping operation. This requires a large amount of the abrasive agent and therefore increases the running cost.

Description will proceed to a wafer lapping method according to embodiments of this invention.

At first, a wafer lapping method according to a first embodiment of this invention will be described.

Figure 11:
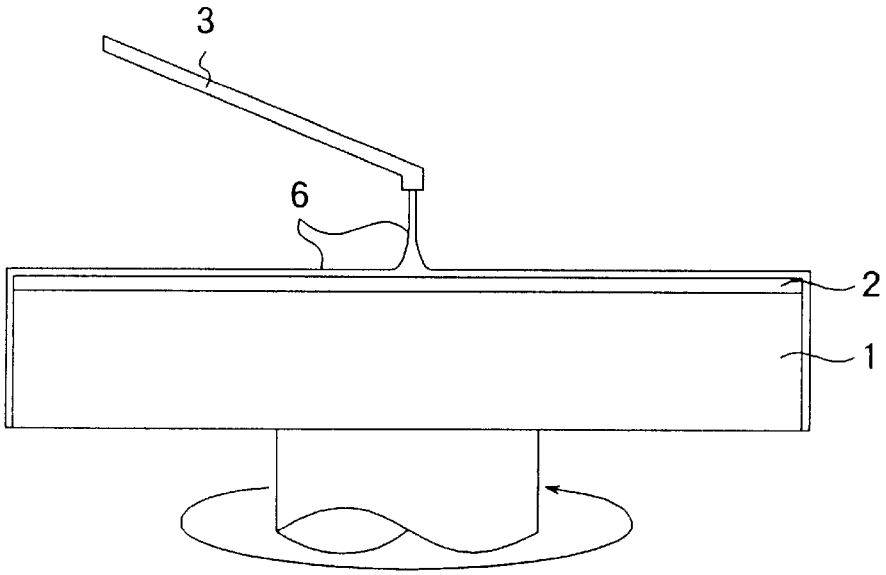
FIG. 11 is a side view for describing a standby state of the wafer lapping device of FIGS. 1 and 2 in a wafer lapping method according to a first embodiment of this invention.

It is assumed that an abrasive agent 7 (FIG. 2) has a pH between 9.5 and 11 and includes abrasive particles containing silica. In a standby state of a device between one lot processing step and another lot processing step, a KOH water solution 6 having a pH adjusted to be similar to that of the abrasive agent 7 is made to flow from a chemical solution feeding port 3 onto an abrasion pad 2 as illustrated in FIG. 11. The KOH water solution 6 acts as a chemical solution for use in preventing agglomeration of the abrasive particles (silica) contained in the abrasive agent 7 which remains on the abrasion pad 2. The KOH water solution 6 prevents the abrasion pad 2 from drying. Upon prevention of the drying, the KOH water solution 6 is made to flow at a flow rate of 200 cc/min while an abrasion table 1 is rotated at 20 rpm for about 30 minutes at two-minute intervals. Thus, the drying is prevented without agglomeration of the abrasive particles in the abrasive agent 7 remaining on the abrasion pad 2.

Figure 12:
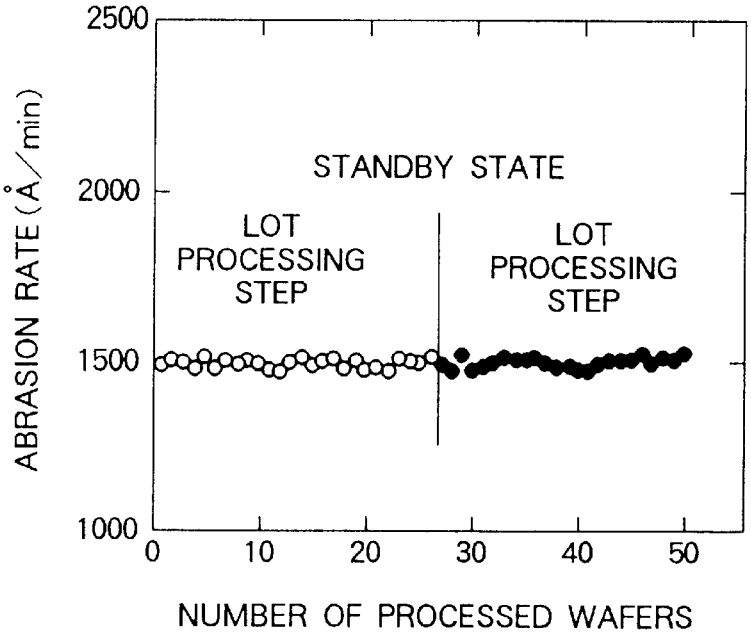
FIG. 12 is a graph showing variation of an abrasion rate in the wafer lapping method according to the first embodiment of this invention.

An abrasion rate immediately after the above-mentioned standby state is stable with respect to that before the standby state, as illustrated in FIG. 12. Therefore, a lapping operation can be stably carried out without changing an abrasion time before and after the standby state. A chemical solution for preventing the agglomeration is not restricted to the KOH water solution 6 but may be an ammonia water solution or alkali ion water. Note that recycling is possible of a regenerated chemical solution prepared by collecting as a collected solution the chemical solution after flowing over the abrasion pad 2 and the abrasive agent having been used, removing the particles in the collected solution, and adjusting its pH to a level between 9.5 and 11 sufficient to prevent the agglomeration of silica. Such recycling of the chemical solution advantageously reduces the running cost.

Next, description will be made as regards a wafer lapping method according to a second embodiment of this invention.

Figure 13:
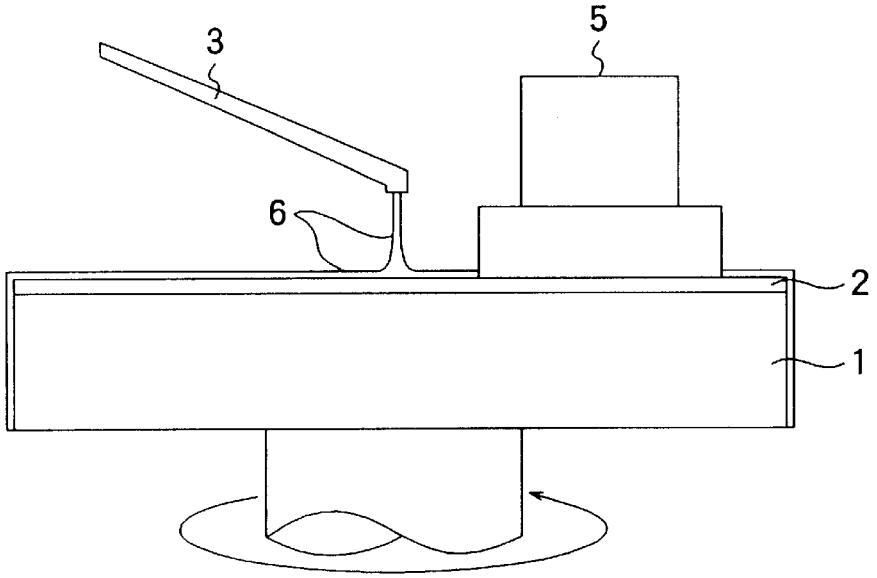
FIG. 13 a side view for describing an abrasion pad dressing operation of the wafer lapping device of FIGS. 1 and 2 in a wafer lapping method according to a second embodiment of this invention.

It is assumed that the abrasive agent 7 (FIG. 2) has the pH between 9.5 and 11 and includes the abrasive particles containing silica. In case where wafer processing steps are successively carried out, the surface of the abrasion pad 2 is dressed by a surface adjusting mechanism 5 between one wafer processing step and another wafer processing step while the KOH water solution 6 having a pH value adjusted to be similar to that of the abrasive agent 7 is made to flow from the chemical solution feeding port 3 onto the abrasion pad 2 as illustrated in FIG. 13 to prevent the agglomeration of the abrasive particles in the abrasive agent 7. Upon dressing, the surface adjusting mechanism 5 is pressed against the abrasion pad 2 at a pressure of 50 g/cm$^2$ while the abrasion table 1 is rotated at 30 rpm with the KOH water solution 6 made to flow at a flow rate of 100 cc/min.

Figure 14:
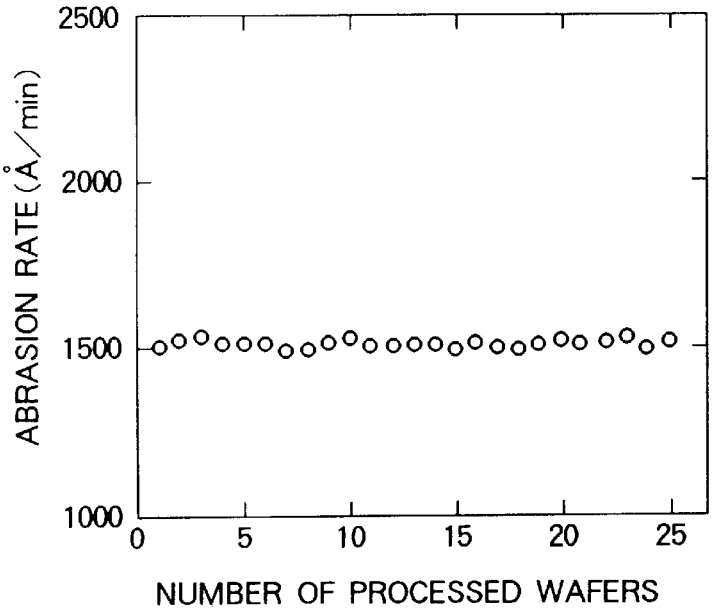
FIG. 14 is a graph showing variation of an abrasion rate in the wafer lapping method according to the second embodiment of this invention.

By dressing the abrasion pad 2, the abrasion rate is stabilized between the wafers as illustrated in FIG. 14. As a result, the uniformity between the abrasion rates of the wafers is improved from 10% to 2%. In addition, the amount of the abrasive agent made to flow onto the pad prior to the lapping operation can be reduced. This reduces the running cost. The chemical solution is similar to that used in the first embodiment.

Next, a wafer lapping method according to a third embodiment of this invention will be described.

Figure 15:
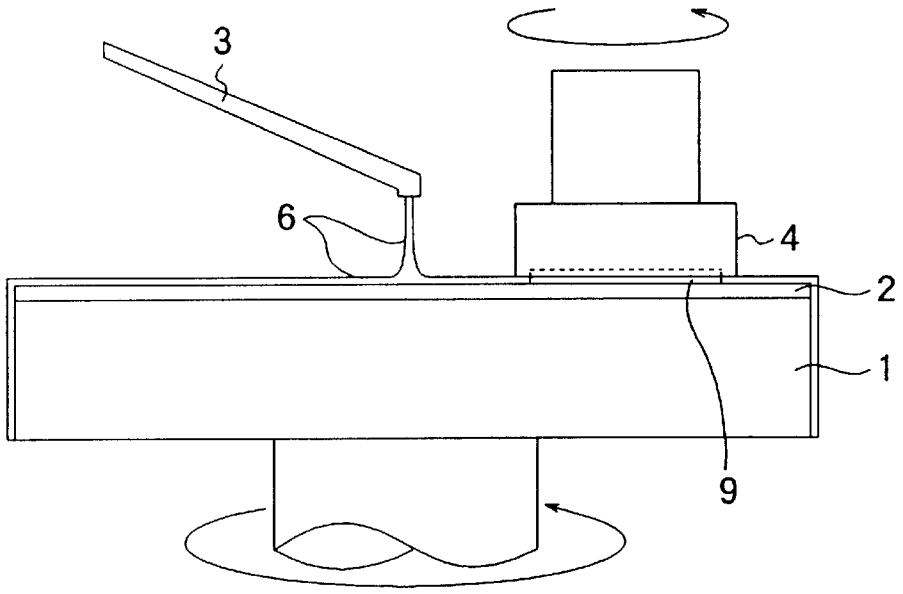
FIG. 15 is a side view for describing a wafer detaching operation carried on a lapping completion state of the wafer lapping device of FIGS. 1 and 2 in a wafer lapping method according to a third embodiment of this invention.
Figure 16:
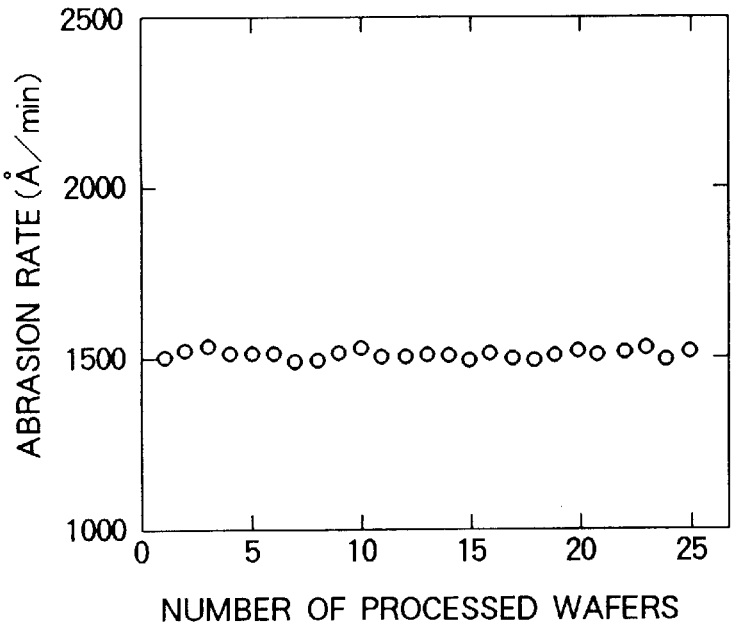
FIG. 16 is a graph showing variation of an abrasion rate in the wafer lapping method according to the third embodiment of this invention.

It is assumed that the abrasive agent 7 (FIG. 2) has the pH between 9.5 and 11 and includes the abrasive particles containing silica. In case where the wafer processing steps are successively carried out, the wafer 9 is detached from the abrasion pad 2 upon completion of the lapping operation of the wafer 9 while the KOH water solution 6 having a pH adjusted to be similar to that of the abrasive agent 7 is made to flow from the chemical solution feeding port 3 onto the abrasion pad 2 as illustrated in FIG. 15. Upon detachment of the wafer 9, the abrasion table 1 is rotated at 20 rpm and a wafer seating base 4 is rotated at 20 rpm with the KOH water solution 6 made to flow at a flow rate of 100 cc/min. By detaching the wafer 9 in the manner described above, the abrasion rate is stabilized between the wafers as illustrated in FIG. 16. As a result, the uniformity between the abrasion rates of the wafers is improved from 10% to 2%. In addition, the amount of the abrasive agent 7 made to flow onto the abrasion pad 2 prior to the lapping operation can be reduced. This reduces the running cost. The chemical solution is similar to that used in the first embodiment.

As described above, according to this invention, the chemical solution preventing the agglomeration of the abrasive particles in the abrasive agent is made to flow onto the abrasion pad in the standby state of the device between one lot processing step and another lot processing step. Thus, it is possible to achieve a stable abrasion rate and to improve a work efficiency without carrying out the dummy run in the following processing step.

According to this invention, in case where the wafer processing steps are successively carried out, the surface of the pad is dressed between one wafer processing step and another wafer processing step while the chemical solution preventing agglomeration of the abrasive particles in the abrasive agent is made to flow onto the abrasion pad. Thus, the uniformity between the abrasion rates of the wafers in the successive processing steps is improved.

According to this invention, in case where the wafer processing steps are successively carried out, the wafer is detached from the abrasion pad upon completion of the lapping operation of the wafer while the chemical solution preventing the agglomeration of the abrasive particles in the abrasive agent is made to flow onto the abrasion pad. Thus, the uniformity between the abrasion rates of the wafers in the successive processing steps is improved.

While this invention has thus far been described, it will be readily be understood for those skilled in the art to put this invention in various other manners.

What is claimed is:

1. In a wafer lapping method wherein a plurality of wafers are successively processed including the step of lapping irregularities of a surface of each wafer to flatten the surface of said wafer by pressing the surface of said wafer against an abrasion pad with an abrasive agent containing abrasive particles fed onto the surface of said abrasion pad, and each wafer is detached from the abrasive pad upon completion of the lapping step, the improvement which comprises discontinuing the feed of said abrasive agent onto the surface of said abrasion pad upon completion of each said lapping step, and thereafter feeding onto the surface of said abrasion pad between each lapping step a specific purpose chemical solution for preventing agglomeration and thus increased particle size of abrasive particles contained in said abrasive agent which remain on the surface of said abrasion pad, the feed of said specific purpose chemical solution onto the surface of said abrasion pad being carried out to prevent fluctuation of an abrasion rate before and after feed of said specific purpose chemical solution onto the surface of said abrasion pad.

2. In a wafer lapping method wherein a plurality of wafers are successively processed including a first step of lapping, by the use of a wafer lapping device comprising an abrasion pad and a feeding section for feeding onto said abrasion pad an abrasive agent containing abrasive particles, irregularities of a surface of each wafer to flatten the surface of said wafer by pressing the surface of said wafer against said abrasion pad with said abrasive agent fed onto the surface of said abrasion pad from said feeding section, and each wafer is detached from the abrasive pad upon completion of the first step, the improvement which comprises discontinuing the first step and thereafter conducting a second step between each first step in which a chemical solution is fed onto the surface of said abrasion pad while said wafer lapping device is in a standby state, said chemical solution comprising a specific purpose chemical solution for preventing agglomeration and thus increased particle size of abrasive particles contained in said abrasive agent which remain on the surface of said abrasion pad, the feed of said specific purpose chemical solution onto the surface of said abrasion pad being carried out to prevent fluctuation of an abrasion rate before and after feed of said specific purpose chemical solution onto the surface of said abrasion pad.

3. In a wafer lapping method as claimed in claim 2, the improvement which comprises discontinuing the second step and thereafter conducting a third step of lapping, following said second step, irregularities of a surface of a different wafer to flatten the surface of said different wafer by pressing the surface of said different wafer against said abrasion pad with said abrasive agent fed onto said abrasion pad from said feeding section.

4. In a wafer lapping method wherein a plurality of lots of wafers are successively processed including: a first lot-lapping step of successively lapping, by the use of a wafer lapping device comprising an abrasion pad and a feeding section for feeding onto said abrasion pad an abrasive agent containing abrasive particles, irregularities of surfaces of a first lot of wafers to successively flatten the surfaces of said first lot of wafers by successively pressing the surfaces of said first lot of wafers against said abrasion pad with said abrasive agent fed onto the surface of said abrasion pad from said feeding section; and successive lot-lapping steps of successively lapping, by the use of said wafer lapping device, irregularities of surfaces of a second lot of wafers to successively flatten the surfaces of said second lot of wafers by successively pressing the surfaces of said second lot of wafers against said abrasion pad with said abrasive agent fed onto the surface of said abrasion pad from said feeding section, the improvement which comprises a standby state of said wafer lapping device between each said lot-lapping steps, in which (a) feeding of said abrasive agent onto the surface of said abrasion pad is discontinued and each said lot is detached from said abrasive pad, and (b) a specific purpose chemical solution for preventing agglomeration and thus increased particle size of abrasive particles contained in said abrasive agent which remain on said abrasion pad is fed onto the surface of said abrasion pad, the feed of said specific purpose chemical solution onto the surface of said abrasion pad being carried out to prevent fluctuation of an abrasion rate before and after feed of said specific purpose chemical solution onto the surface of said abrasion pad.

5. In a wafer lapping method wherein a plurality of wafers are successively processed including a plurality of wafer-lapping steps of successively lapping irregularities of surfaces of a plurality of wafers to successively flatten the surfaces of said plurality of wafers by successively pressing the surfaces of said plurality of wafers against a surface of an abrasion pad with an abrasive agent containing abrasive particles fed onto the surface of said abrasion pad, the improvement which comprises discontinuing feeding abrasion agent onto the surface of said abrasion pad and detaching said wafers from said abrasion pad, and performing a dressing step between said plurality of wafer-lapping steps, in which the surface of said abrasion pad is dressed with a chemical solution fed onto the surface of said abrasion pad, said chemical solution being a specific purpose chemical solution for preventing agglomeration and thus increased particle size of abrasive particles contained in said abrasive agent which remain on the surface of said abrasion pad, the feed of said specific purpose chemical solution onto the surface of said abrasion pad being carried out to prevent fluctuation of an abrasion rate before and after feed of said specific purpose chemical solution onto the surface of said abrasion pad.

6. In a wafer lapping method wherein a plurality of wafers are successively processed including a plurality of wafer-lapping steps of successively lapping irregularities of surfaces of said plurality of wafers to successively flatten the surfaces of said plurality of wafers by successively pressing the surfaces of said plurality of wafers against an abrasion pad with an abrasive agent containing abrasive particles fed onto the surface of said abrasion pad, the improvement which comprises discontinuing feeding abrasive particles onto the surface of said abrasion pad upon completion of each of said plurality of wafer-lapping steps, and detaching said plurality of wafers from said abrasion pad upon completion of each said lapping step, and feeding a chemical solution onto the surface of said abrasion pad between each said lapping step, said chemical solution being a specific purpose chemical solution for preventing agglomeration and thus increased particle size of abrasive particles contained in said abrasive agent which remain on the surface of said abrasion pad, the feed of said specific purpose chemical solution onto the surface of said abrasion pad being carried out to prevent fluctuation of an abrasion rate before and after feed of said specific purpose chemical solution onto the surface of said abrasion pad.

* * * * *